US006789727B2

(12) United States Patent
Felice et al.

(10) Patent No.: US 6,789,727 B2
(45) Date of Patent: Sep. 14, 2004

(54) MAIL PROCESSING APPARATUS AND COLLECTION BOX WITH A MAIL ARTICLE SEALER

(75) Inventors: Robert J. Felice, Endicott, NY (US); Patrick J. Fitzgibbons, Owego, NY (US); Louis B. Taylor, Apalachin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 2 days.

(21) Appl. No.: 10/315,333

(22) Filed: Dec. 10, 2002

(65) Prior Publication Data

US 2003/0155412 A1 Aug. 21, 2003

Related U.S. Application Data

(60) Provisional application No. 60/340,069, filed on Dec. 10, 2001.

(51) Int. Cl.[7] ..... B65G 11/04

(52) U.S. Cl. ..... 232/44

(58) Field of Search ..... 232/45, 44, 43.3, 232/30–32; 156/353, 364

(56) References Cited

U.S. PATENT DOCUMENTS

| | | | | | |
|---|---|---|---|---|---|
| 787,476 | A | * | 4/1905 | Sheley | 232/31 |
| 4,363,438 | A | | 12/1982 | Connor | |
| 6,283,188 | B1 | * | 9/2001 | Maynard et al. | 156/521 |
| 6,315,020 | B1 | | 11/2001 | Seki | |
| 6,427,744 | B2 | | 8/2002 | Seki et al. | |
| 2003/0106929 | A1 | * | 6/2003 | Day et al. | 232/30 |
| 2003/0127505 | A1 | * | 7/2003 | Avant | 232/30 |

FOREIGN PATENT DOCUMENTS

JP 2002-170150 A * 6/2002

* cited by examiner

*Primary Examiner*—William L. Miller
(74) *Attorney, Agent, or Firm*—Perkins Smith & Cohen LLP; Jacob N. Erlich; Peter J. Borghetti

(57) ABSTRACT

A mail processing apparatus, includes an enclosure adapted for receiving deposited mail articles, a depository port adapted for passing deposited mail articles into the enclosure, and a sealing apparatus operatively associated with the depository port and adapted to seal deposited mail articles that pass through the depository port. The sealing apparatus may be a laminator adapted to apply a layer of plastic material to opposing sides of deposited mail articles.

6 Claims, 2 Drawing Sheets

MAIL PROCESSING APPARATUS AND COLLECTION BOX WITH A MAIL ARTICLE SEALER

RELATED APPLICATIONS

The present application claims priority from U.S. Provisional Patent Application Ser. No. 60/340,069, filed Dec. 10, 2001 and entitled COLLECTION BOX WITH A MAIL ARTICLE SEALER.

FIELD OF THE INVENTION

The present invention generally relates to mail collection, and in particular to the containment of hazardous materials deposited into the mail collection system.

BACKGROUND OF THE INVENTION

The recent incidents of anthrax-laced letters being transported through the United States Postal Service (USPS) facilities by unsuspecting mail handlers to unsuspecting recipients has alarmed the nation and the world. Currently, the tainted letters are discovered after the recipient accepts delivery or by alert postal employees noticing white powder that could be anthrax on mail parcels, sorting and distribution equipment, or themselves. There appear to be no current security devices or procedures that are available to intercept such letters at the earliest source of introduction into the USPS system.

Therefore, it would be advantageous to be able to isolate items deposited into the mail collection system, so that adequate testing may be performed to detect the presence of any contaminants.

SUMMARY OF THE INVENTION

Accordingly, one embodiment of the present invention provides a mail processing apparatus, including an enclosure adapted for receiving deposited mail articles, a depository port adapted for passing deposited mail articles into the enclosure, and a sealing apparatus operatively associated with the depository port and adapted to enclose deposited mail articles in a sealing layer.

The sealing apparatus may be a laminator adapted to apply a layer of plastic material to opposing sides of deposited mail articles. The laminator may be adapted to sense the presence of deposited mail articles and to be activated in response to such sensed mail articles to laminate them. The laminator may comprise a separate roll of plastic material adapted for providing the layer of plastic material for each opposing side of the deposited mail articles and means for cutting applied plastic layers between sequentially laminated mail articles. The depository port may be sized to limit the thickness of deposited mail like articles which may be passed through the depository port. Also, the enclosure may be a public collection box.

BRIEF DESCRIPTION OF THE DRAWINGS

The present invention is illustratively shown and described in reference to the accompanying drawings, in which.

DETAILED DESCRIPTION OF THE DRAWINGS

Figure 1:
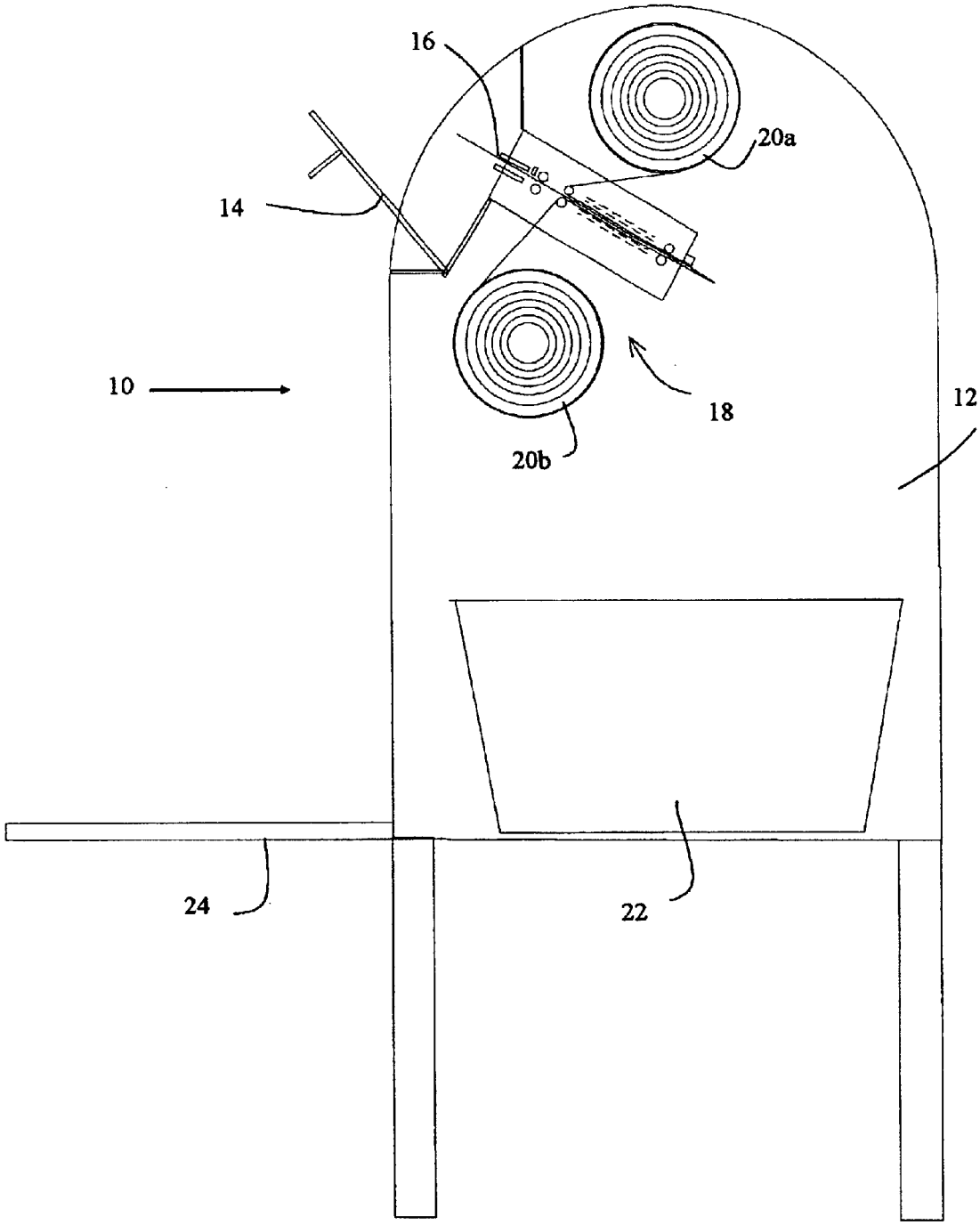
FIG. 1 is a side view of a mail processing apparatus constructed in accordance with one embodiment of the present invention.

FIG. 1 shows a mailbox 10 forming a secure enclosure 12 and having a mailbox hinged door 14, inlet guide 16, a mail sealing device 18, rolls of sealing media 20*a*, 20*b*, a conventional mail tub 22, and a mail tub access door 24. The mail sealing device 18 can be positioned adjacent to the door 14.

Figure 2:
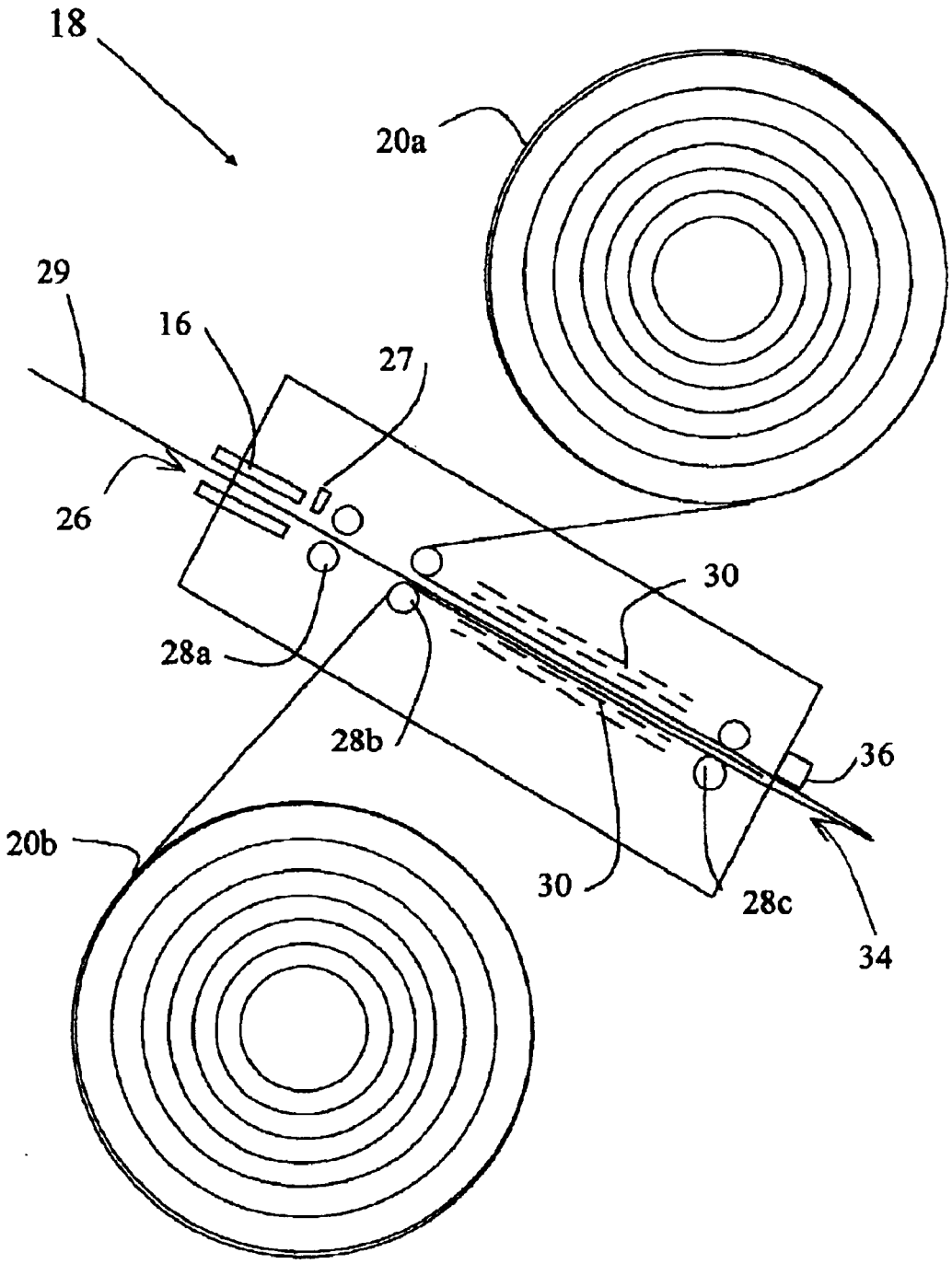
FIG. 2 is a side view of a mail sealer device suitable for use in the embodiment of FIG. 1.

Now referring to FIG. 2, for illustration purposes the mail sealing device 18 is a laminator having an inlet 26 with a conventional sensor or switch 27 positioned at the inlet 26 to sense the presence of the mail article 29. The sensor 27 is used to signal a conventional drive mechanism (not shown) to start the conveyor rollers 28*a*, 28*b*, 28*c* and the heating elements 30. The conveyor rollers 28*a* pull the mail article into sealing device 18. Conveyor rollers 28*b* draw the sealing media 20*a*, 20*b* from their respective rolls and against any mail article. The preferred sealing media is a plastic laminate or wrap. Guide 16 forms a depository port which aligns the mail article to prevent jamming and to assure a complete seal around the perimeter of the mail article.

The mail article is sealed between the opposing sealing media 20*a*, 20*b* by the heating elements 30. Any suitable sealing method may be used, such as heating elements 30 or self sticking laminate. Examples of such laminates are described in U.S. Pat. Nos. 6,315,020 and 6,427,744.

The conveyor rollers 28*c* advance the mail article to the cutting blade 36 located at the exit 34 of the sealing device 18 where the laminate is cut between articles of sealed mail. Sealing device 18 may further include a sensor such, as an optical device, located at exit 34 to ensure that the laminate material is only cut between serially enclosed mail articles. The mail article drops into the mail tub 22 after cutting takes place. The mail sealing device 18 may be a box-like structure sufficiently encased to prevent the spreading of contamination if contaminate is released into the sealing device 18 as the mail article is squeezed by the conveyor rollers 28*a* or 28*b*.

The mail sealing device 18 can be any conventional sealing mechanism capable of enclosing a substantially flat mail article in a non-permeable layer or otherwise to prevent the leakage of hazardous materials such as particulate matter in the size range of 2–10 microns, including but not limited to anthrax. The mail sealing device 18 described herein as a laminator, is provided for illustration purposes and should not be construed as a limitation. It will be apparent to those skilled in the art that other mail sealing devices can be adapted to a conventional mailbox for the purposes of enclosing deposited mail articles in a sealing layer. A sealing layer may be applied by any suitable suitable means including, but not limited to, spraying an aerosol. The apparatus of the present invention is also not limited to use at a corner collection box and may be used in both the public access and restricted areas of a postal facility.

Although the invention has been described with respect to various embodiments, it should be realized this invention is also capable of a wide variety of further and other embodiments within the spirit and scope of the present invention.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A mail processing apparatus, comprising:

a container adapted for receiving deposited mail articles and being capable of retaining a plurality of the deposited mail articles therein;

a depository port, operably connected to said container, adapted for passing the deposited mail articles into said container; and a sealing apparatus operatively associated with said depository port and adapted to enclose the deposited mail articles in a sealing layer.

2. The mail processing apparatus of claim 1, wherein said sealing apparatus is a laminator adapted to apply a layer of plastic material to opposing sides of the deposited mail articles.

3. The mail processing apparatus of claim 2, wherein said laminator is adapted to sense the presence of the deposited mail articles and to be activated in response to such sensed mail articles to laminate the sensed mail articles.

4. The mail processing apparatus of claim 3, wherein said laminator comprises a separate roll of plastic material adapted for providing said layer of plastic material for each opposing side of the deposited mail articles and means for cutting said applied plastic layers between sequentially laminated mail articles.

5. The mail processing apparatus of claim 1, wherein said depository port is sized to limit the thickness of the deposited mail articles which may be passed through said depository port.

6. The mail processing apparatus of claim 1, wherein said container is a public collection box.

* * * * *